US006168332B1

(12) United States Patent
Puritscher et al.

(10) Patent No.: US 6,168,332 B1
(45) Date of Patent: Jan. 2, 2001

(54) TRANSFER PRINTING STATION WITH ADJUSTABLE-WIDTH PAPER CONVEYOR MEANS

(75) Inventors: Ernst Puritscher, Unterhaching; Adolf Höfler, München; Josef Windele, Puchheim, all of (DE)

(73) Assignee: Oce Printing Systems GmbH, Poing (DE)

( * ) Notice: Under 35 U.S.C. 154(b), the term of this patent shall be extended for 0 days.

(21) Appl. No.: 09/051,075

(22) PCT Filed: Jun. 27, 1996

(86) PCT No.: PCT/DE96/01146

§ 371 Date: Jul. 20, 1998

§ 102(e) Date: Jul. 20, 1998

(87) PCT Pub. No.: WO97/13642

PCT Pub. Date: Apr. 17, 1997

(30) Foreign Application Priority Data

Oct. 9, 1995 (DE) ..... 195 37 611

(51) Int. Cl.[7] ..... B41J 11/32
(52) U.S. Cl. ..... 400/616.1; 400/616
(58) Field of Search ..... 400/616.1, 616, 400/611, 584, 589, 616.2, 616.3

(56) References Cited

U.S. PATENT DOCUMENTS 2,683,599 * 7/1954 Davidson et al. ..... 400/616.3
4,345,708 * 8/1982 Hubbard ..... 400/616.1
4,974,979 * 12/1990 Cardenas ..... 400/616.1

FOREIGN PATENT DOCUMENTS 32 32 875 A1 9/1982 (DE) .
0 501 130 A2 1/1992 (EP) .
1407100 5/1964 (FR) .
0062176 * 5/1981 (JP) ..... 600/616
404265769 * 9/1992 (JP) ..... 400/616
WO 94/27193 11/1994 (WO) .

OTHER PUBLICATIONS

Kratzert, "Independent Dual Form Feed", , IBM Technical Disclosure Bulletin, vol. 20, No. 8 Jan. 1978.

* cited by examiner

*Primary Examiner*—John S. Hilten
*Assistant Examiner*—Anthony H. Nguyen
(74) *Attorney, Agent, or Firm*—Hill & Simpson

(57) ABSTRACT

A transfer printing station is provided which has two pairs of tractor drives movably arranged side-by-side on two drive shafts. During operation with only a single paper web, the unused tractor drives can be moved to a lateral parking position. The two pairs of tractor drives can be easily moved to match two different webs of paper of different widths. The structure enables a user to adapt the paper conveyor of a transfer printing station to operate with only a single paper web or two parallel webs.

22 Claims, 2 Drawing Sheets

TRANSFER PRINTING STATION WITH ADJUSTABLE-WIDTH PAPER CONVEYOR MEANS

FIELD OF THE INVENTION

The invention relates to a transfer printing station for a printer or copier device, for accepting one or more recording media webs such as paper that are of different widths and that comprise strip-type edge perforations, said media webs being driven via a transport means that engages in the edge perforations.

BACKGROUND OF THE INVENTION

Transfer printing stations are known. For example, see WO 94/27193. For the adapting of the transport means to various recording media widths, the known transport means can be fashioned so as to be adjustable in width. This can be achieved for example in that the drive wheels, which carry the transport strips (nap strips) that engage in the edge perforations of the recording medium, are movably mounted on polygonal shafts.

In order to guide two narrow recording media next to one another in parallel operation on both sides in the area of the transfer printing station, separate transport elements can be arranged in the center that engage in edge perforations of the recording media. In order to prevent these transport elements from having a disturbing effect during operation with a recording medium only one width, they can be arranged so as to be attachable and detachable, or so that they can be pivoted away, or else it is possible to provide the drive wheels of the transport means with pins or, respectively, naps that can be extended and retracted.

All proposed solutions for the width-adaptable construction of the transport means are expensive, difficult to handle, and require a great deal of space.

SUMMARY OF THE INVENTION

It is thus the object of the invention to construct a transfer printing station of the type named above in such a way that it can be adapted in a simple, user friendly way to the various operating states with various recording media widths.

In an embodiment, the present invention provides a transfer printing station for conveying either a single wide paper web or two narrower paper webs or one narrower paper web. Each paper web has opposing edges with perforations disposed therein for engaging tractor drives. The transfer printing station of the present invention comprises at least one drive shaft that passes through two pairs of tractor drives including a first tractor drive pair including a first tractor drive and a second tractor drive and a second tractor drive pair including a third pair tractor drive and a fourth tractor drive.

The second tractor drive is disposed along the drive shaft between the first and third tractor drives. The third tractor drive is disposed along the drive shaft between the second and fourth tractor drives. Each pair of tractor drives engages preforations in opposing edges of one of the paper webs. The second tractor drive is slidable along the drive shaft towards and away from the first tractor drive. Both the third and fourth tractor drives are slidable along the drive shaft towards and away from each other and away from the first and second tractor drives to a distal park region of the drive shaft which enables the second tractor drive to be moved away from the first tractor drive for accomodating a single wide paper web.

In an embodiment, the transfer printing station further comprises a first control shaft threadably coupled to the third tractor drive whereby rotation of the first control shaft results in lateral movement of the third tractor drive along the drive shaft. The transfer printing station of the present invention also comprises a second control shaft threadably connected to the second tractor drive whereby rotation of the second control shaft results in lateral movement of the second tractor drive along the drive shaft. The first control shaft is connected to a first output part against rotation with respect to the first output part. The first output part comprises a catch gearing for engaging a rotational drive element. Further, the first control shaft passes through a second output part so that the first control shaft is free to rotate within the second output part without imparting rotation to the second output part.

However, the second output part comprises a catch gearing for engaging the drive element. The second output part is coupled to a carrier part that is connected to the second control shaft against rotation with respect to the second control shaft. The drive element is movable between the catch gearing of the first output part and the catch gearing of the second output part. When the drive element engages the catch gearing of the first output part, rotation of the drive element results in rotation of the first output part, the first control shaft and the third tractor drive thereby resulting in lateral movement of the third tractor drive along the drive shaft. When the drive element engages the catch gearing of the second output part, rotation of the drive element results in rotation of the second output part, the carrier part, the second control shaft and the second tractor drive thereby resulting in lateral movement of the second tractor drive along the drive shaft.

In an embodiment, the second output part is enmeshed with a ring gear, the ring gear being enmeshed with the carrier part.

In an embodiment, the drive element is slidably mounted to the first control shaft and is movable along the first control shaft between engagement with the catch gearing of the first output part and the catch gearing of the second output part.

In an embodiment, the first output part comprises a magnet for securing the drive element against the first output part when the drive element is moved into engagement with the first output part for imparting rotational movement to the first output part.

In an embodiment, the second output part further comprises a magnet for securing the drive element against the second output part when the drive element is moved into engagement with the second output part for imparting rotational movement to the second output part.

In an embodiment, the drive element comprises a handle for imparting rotation to the drive element.

In an embodiment, the transfer printing station further comprises a frame with a catch pin being mounted to the frame at selected positions along the frame. The catch pin engages the fourth tractor drive for securing the fourth tractor drive in position during operation of the transfer printing station.

In an embodiment, the transfer printing station further comprises a brake element disposed between the carrier part and the second control shaft to prevent rotation of the second control shaft with respect to the carrier part during operation of the printing station.

In an embodiment, the transfer printing station further comprises a brake element disposed between the second output part and the first control shaft to prevent rotation of the first control shaft with respect to the second output part during operation of the printing station.

In an embodiment, the brake elements are plate springs.

In an embodiment, the first control shaft is threadably connected to the third tractor drive by a threaded bushing.

In an embodiment, the second control shaft is threadably connected to the second tractor drive by a threaded bushing.

In an embodiment, the transfer printing station further comprises an adjustment rule or ruler disposed parallel to the drive shaft.

In an embodiment, the second output part comprises a toothed wheel and the carrier part comprises a toothed wheel enmeshed with the second output part.

The invention makes it possible in a simple way to adapt, with different widths, the transfer printing station to the various operating states, such as operation with a paper web of only one width or operation with two parallel narrow paper webs. For this purpose, the transfer printing station contains two tractor drive pairs that are arranged movably next to one another on a drive shaft. In operation a paper web of one width, the tractor drive of the unneeded tractor drive pair is moved into a lateral park position. In all operational states, a simple and exact width matching of the tractor drives to various paper widths is possible via control shafts.

Other objects and advantages of the present invention will become apparent from reading the following detailed description and appended claims, and upon reference to he acompantying drawings.

BRIEF DESCRIPTION OF THE DRAWINGS

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

It should be understood that the drawings are not necessarily to scale and that the embodiments are sometimes illustrated by graphic symbols, phantom lines, diagrammatic representations and fragmentary views. In certain instances, details which are not necessary for an understanding of present invention or which render other details difficult to preceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
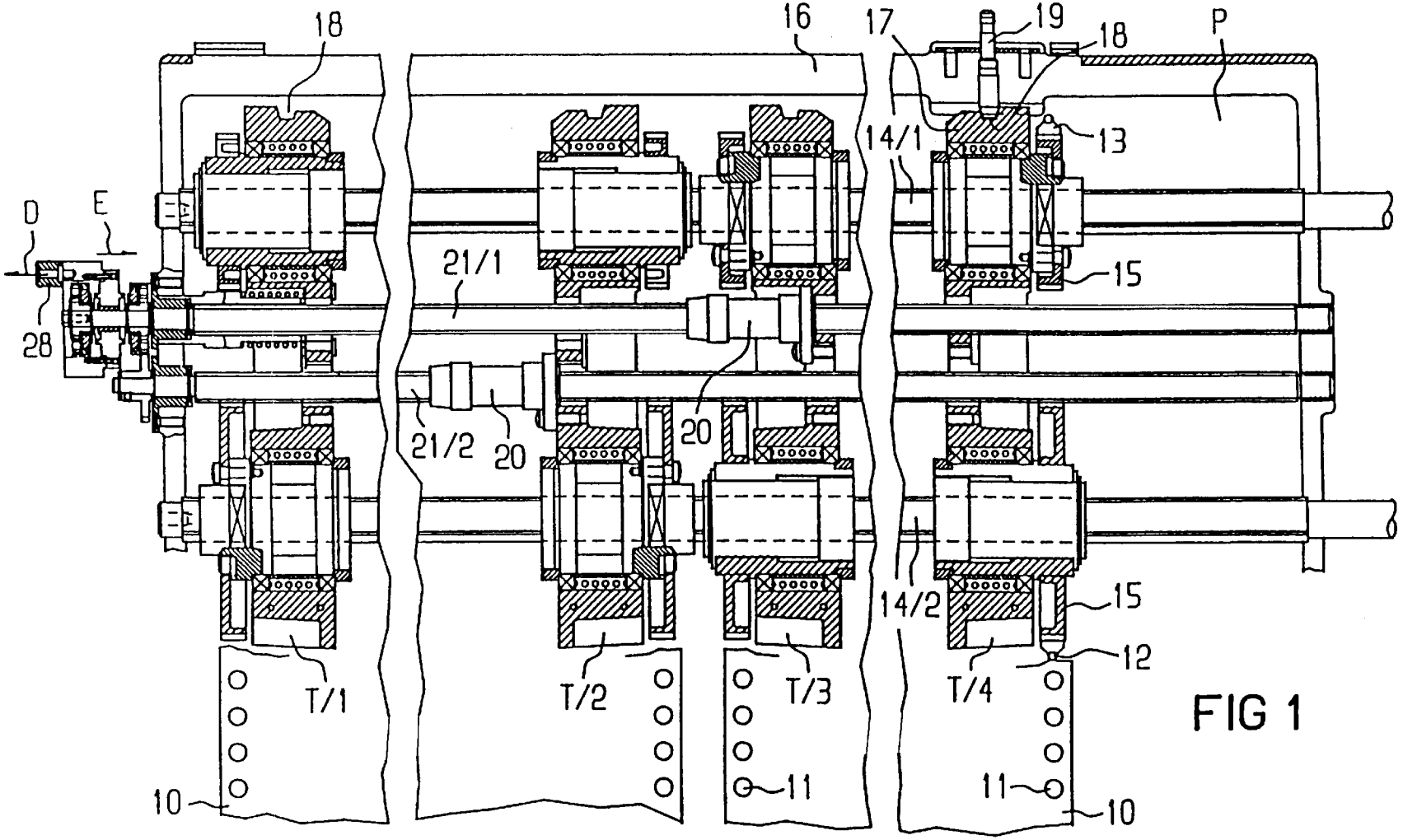
FIG. 1 is a schematic sectional representation of a transfer printing station with an adjustable-width tractor drive arranged therein.
Figure 2:
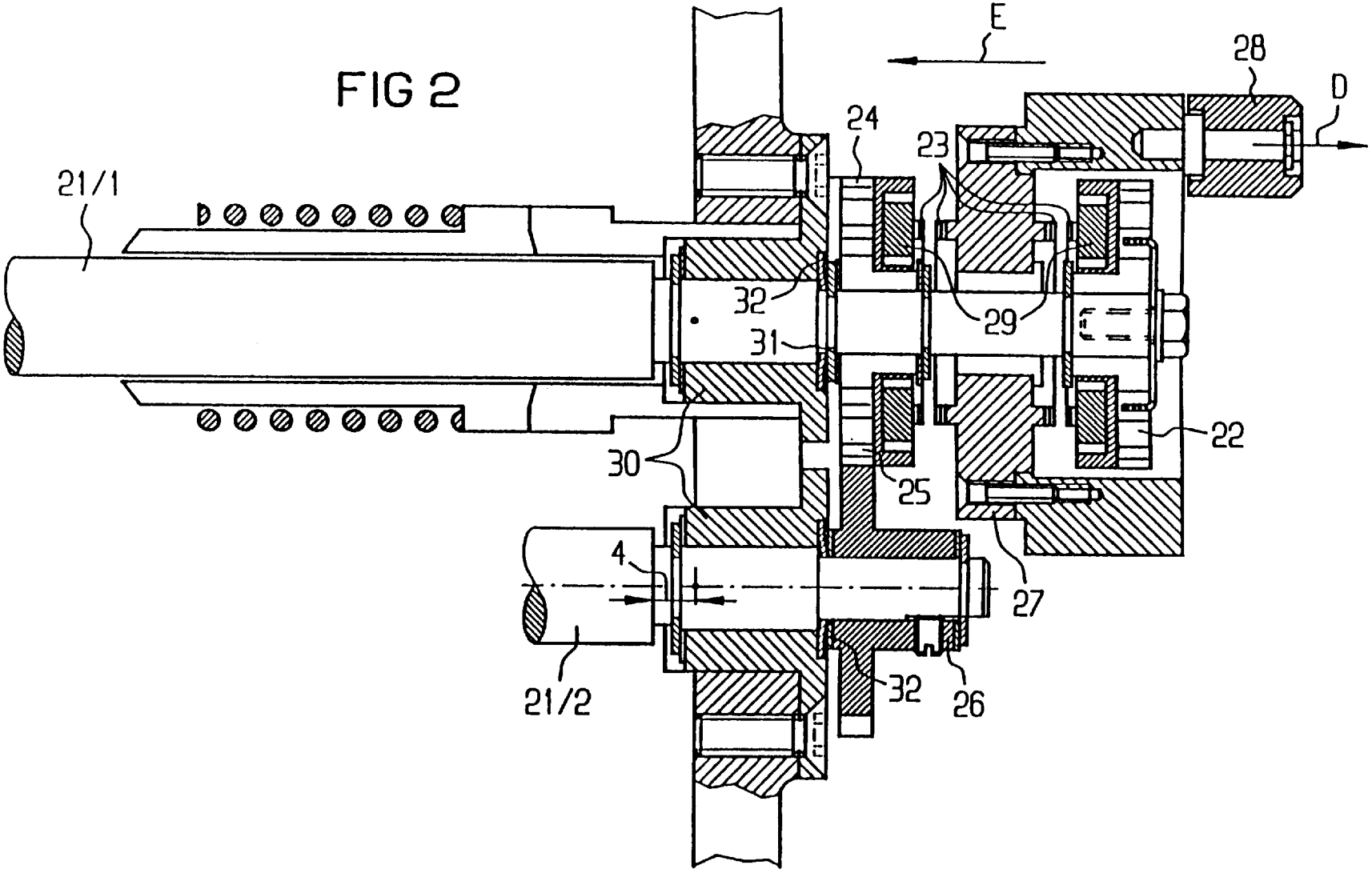
FIG. 2 is a schematic sectional representation of a control actuator for the tractor drive.

An electrophotographic printer means for printing on strip-type recording media of different widths, as described in more detail in WO 94/27193, contains a transfer printing station with a paper transport group shown in FIGS. 1 and 2. Via the transfer printing station, in the parallel operation shown two recording media 10 in two paper webs A and B are led at constant speed past a transfer printing saddle on a photoconductor drum, where the transfer printing, i.e. the transition of the toner from the photoconductor to the recording media 10, takes place. For the transport of the recording media, the paper webs A and B comprise edge perforations 11 in which pins 12 of transport crawlers 13 of first, second, third and fourth tractor drives T/1, T/2, T/3, T/4 engage. The paper web B can be the same as the paper web A if the paper web A, as described in more detail in WO 94/27193, is diverted in the printer and runs through the paper transport as a paper web B.

In parallel operation with two narrow paper webs A and B (A4 format), four tractor drives T/1, T/2, T/3, T/4 are engaged, with their transport crawlers 13, with the edge perforations 11 of the paper webs A and B.

Given operation with only one paper web (not shown) that extends over the overall width of the two paper webs A and B (A3 format), the tractor drives T/3, T/4 are displaced all the way to the right, into a parked position P.

In order to enable this adapting to the various operational states of the transfer printing station, the tractor drives T/1, T/2, T/3, T/4 are movably arranged on two drive shafts 14/1 and 14/2, which are coupled with a motor. These consist of polygonal shafts that engage in corresponding guides of the support wheels 15 that carry the transport crawlers 13. The drive shafts 14/1 and 14/2 are mounted in the frame 16 of the transfer printing station. The frame 16, and thus the range of motion of the tractor drives T/1, T/2, T/3, T/4, extends beyond the width of the actual transfer printing region into a lateral park region P, which serves to receive the tractor drives T/3, T/4 in operation with only one paper web.

In order to enable precise stationary positioning of the two outermost tractor drives T/1 and T/4 in operation with two paper webs A and B, the cast body 17 of the tractor drives contains a guide groove 18 for the acceptance of a catch pin 19 fastened in the frame 16. The tractor drive T/1 can also be fastened immediately to the frame 16 in stationary fashion, since it usually remains in this position in all operating states.

For the displacement of the tractor drives T/2 and T/3, these drives are coupled via threaded bushings 20 with first and second control shafts 21/1 and 21/2, with threads arranged thereon. The control shafts 21/1 and 21/2 are mounted rotatably in the frame 16, and are connected with a control gear unit, shown in FIG. 2.

The control gear unit contains a first wheel-shaped output part 22 fastened in rotationally fixed fashion on the control shaft 21/1, with a catch gearing 23 arranged thereon. In addition, a second output part 24, mounted rotatably at a distance on the control shaft 21/1 and fashioned as a toothed wheel, and having a catch gearing 23 and a ring gear 25 via which the output part 24 is engaged with a toothed wheel 26 (carrier part) fastened in rotationally fixed fashion on the control shaft 21/2.

A drive element 27 (switching element) with a lateral catch gearing 23 is movably arranged on the control shaft 21/1, between the output parts 22, 24. By displacement, the drive element 27 serving as a switching element comes into engagement with the catch gearings 23 of the corresponding output parts 22, 24. A rotating handle 28 is fastened to the drive element 27, via which the drive element 27 can be rotated and can be displaced for switching. In order to enable the drive element 27 to be held in the various switching positions, magnets 29 are arranged on the output parts 22, 24. In the place of magnets, other catch elements can also be used.

Plate springs 32 are arranged as braking elements (frictional brakes) between the bushings 30 that accept the control shafts 21/1 and 21/2 and a ring 31 on the control shaft 21/1 or, respectively, on the toothed wheel 26. The springs serve to hold the control shafts 21/1, 21/2, and thereby the tractor drives, in the adjustment position. In addition, the plate spring 32 adjacent to the toothed wheel 26 prevents a concomitant rotation of the control shaft 21/2 when, by means of being drawn in the arrow direction D and rotation on the rotation handle 28, the control shaft 21/1 is rotated, and the tractor drive T/3 is thereby moved.

By displacement of the drive element 27 in the arrow direction E via the rotational handle 28, the drive element 27 comes to be engaged with the output part 24, by which means the control shaft 21/2, and thereby the tractor drive T/2, can be displaced via the toothed wheel 26.

It is also possible to construct a control gear unit (not shown here) in such a way that, in a third switching position of the switching element, both control shafts are actuated at the same time, and the tractor drives are thereby displaced simultaneously.

The control gear unit makes it possible to adjust the width of each paper web separately in the operating position shown in FIG. 1 with two parallel paper webs A and B. For this purpose, given tractor drives T/1 and T/4 positioned in stationary fashion, the two inner tractor drives T/2 and T/3 are brought into the corresponding desired position by rotation of the rotational handle 28 in the allocated switching position (arrow directions D, E) via the control shafts 21/1, 21/2. The tractor drives T/2 and T/3 are then engaged with the edge perforations 11 of the paper webs A and B.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

In order to enable a precise positioning of the tractor drives even when the paper webs A and B are not yet inserted, an adjustment aid in the form of an adjustment rule can be arranged along the frame 16 of the transfer printing station.

For the adjustment of the transport means in a operating position not shown here, with only one wide paper web, e.g. in the transverse A3 format, first the latching 19 of the tractor drive T/4 is detached, and the tractor drive T/4 is displaced to the right into the park position P. After this, by rotating the rotating handle 28 in the adjustment position "arrow direction D," the tractor drive T/3 is likewise displaced into the park region P. After switching over into the adjustment position "arrow direction E," an adjustment of the tractor drive T/2 via the control shaft 21/1 can then take place, via the rotating handle 28. The tractor drive T/1 thereby remains in a stationary position. Here as well, it is possible, if warranted, to position the tractor drive T/2 without the paper web via an adjustment rule.

What is claimed is:

1. A transfer printing station for conveying one single wide paper web or one or two narrower paper webs, each paper web having opposing edges with perforations therein, the transfer printing station comprising:

at least one drive shaft, two pairs of tractor drives including a first tractor drive pair including a first tractor drive and a second tractor drive and a second tractor drive pair including a third tractor drive and a fourth tractor drive, said at least one drive shaft passing through the first and second tractor drive pairs, the second tractor drive being disposed along the drive shaft between the first and third tractor drives, the third tractor drive being disposed along the drive shaft between the second and fourth tractor drives, each pair of tractor drives for engaging perforations in opposing edges of one of the paper webs, the transfer printing station further comprising a transfer printing region and a distal park region, the distal park region being disposed adjacent to the transfer printing region, the distal park region having a width sufficient to accommodate the second pair of tractor drives, the transfer printing region having a width sufficient to accommodate one single wide paper web and the first pair of tractor drives or two narrower paper webs and the first and second pair of tractor drives, the drive shaft passing through the transfer printing region to the distal park region, the second tractor drive being slidable along the drive shaft towards and away from the first tractor drive, both the third and fourth tractor drives being slidable along the drive shaft towards and away from each other and away from the first and second tractor drives to the distal park region thereby enabling the second tractor drive to be moved away from the first tractor drive for accommodating a single wide paper web.

2. The transfer printing station of claim 1 wherein the drive element comprises a handle for imparting rotation to the drive element.

3. The transfer printing station of claim 1 further comprising a frame with a catch pin being mounted to the frame at selected positions along the frame, the catch pin engaging the fourth tractor drive and securing the fourth tractor drive in position.

4. The transfer printing station of claim 1 further comprising a frame, a first control shaft comprising threads that is rotatable mounted to the frame, the first control shaft being connected to a bushing which engages the third tractor drive whereby rotation of the first control shaft results in lateral movement of the third tractor drive along the drive shaft, and a second control shaft comprising threads that is rotatably mounted to the frame, the second control shaft being connected to a bushing that engages the second tractor drive whereby rotation of the second control shaft results in lateral movement of the second tractor drive along the drive shaft, a rotational drive element, the first control shaft being connected to a first output part, the first output part comprising a catch gearing that engages the rotational drive element, and the first control shaft passing through a second output part, the first control shaft being free to rotate within the second output part without rotation of the second output part, a carrier part, the second output part comprising a catch gearing that engages the rotational drive element, the second output part also being coupled to the carrier part that is connected to the second control shaft, the drive element being movable between the catch gearing of the first output part and the catch gearing second output part.

5. The transfer printing station of claim 4 further comprising a ring gear, and wherein the second output part is coupled to the carrier part by the ring gear that is disposed between the second output part and the carrier park and that is enmeshed with the second output part and the carrier part.

6. The transfer printing station of claim 4 wherein the drive element is slidably mounted to the first control shaft and is movable along the first control shaft between engagement with the catch gearing of the first output part and the catch gearing of the second output part.

7. The transfer printing station of claim 4 wherein the first output part further comprises a magnet for securing the drive element against the first output part when the drive element is moved into engagement with the first output part for imparting rotational movement to the first output part.

8. The transfer printing station of claim 4 wherein the second output part further comprises a magnet for securing the drive element against the second output part when the drive element is moved into engagement with the second output part for imparting rotational movement to the second output part.

9. The transfer printing station of claim 4 further comprising a brake element disposed between the carrier part and the second control shaft to prevent rotation of the second control shaft with respect to the carrier part during operation of the printing station.

10. The transfer printing station of claim 9 wherein the brake element is a plate spring.

11. The transfer printing station of claim 4 further comprising a brake element disposed between the second output part and the first control shaft to prevent rotation of the first control shaft with respect to the second output part during operation of the printing station.

12. The transfer printing station of claim 11 wherein the brake element is a plate spring.

13. The transfer printing station of claim 4 wherein the first control shaft is threadably connected to the third tractor drive by a threaded bushing.

14. The transfer printing station of claim 4 wherein the second control shaft is threadably connected to the second tractor drive by a threaded bushing.

15. The transfer printing station of claim 4 wherein the second output part comprises a toothed wheel and the carrier part comprises a toothed wheel enmeshed with the toothed wheel of the second output part.

16. A transfer printing station for conveying one single wide paper web or one or two narrower paper webs, each paper web having opposing edges with perforations therein, the transfer printing station comprising:

a frame, at least one drive shaft, two pairs of tractor drives including a first tractor drive pair including a first tractor drive and a second tractor drive and a second tractor drive pair including a third tractor drive and a fourth tractor drive, said at least one drive shaft passing through the first and second tractor drive pairs, the second tractor drive being disposed along the drive shaft between the first and third tractor drives, the third tractor drive being disposed along the drive shaft between the second and fourth tractor drives, each pair of tractor drives for engaging perforations in opposing edges of one of the paper webs, the transfer printing station further comprising a transfer printing region and a distal park region, the distal park region being disposed adjacent to the transfer printing region, the distal park region having a width sufficient to accommodate the second pair of tractor drives, the transfer printing region having a width sufficient to accommodate one single wide paper web and the first pair of tractor drives or two narrower paper webs and the first and second pair of tractor drives, the drive shaft passing through the transfer printing region to the distal park region, a first control shaft comprising threads that is rotatable mounted to the frame, the first control shaft being connected to a bushing which engages the third tractor drive whereby rotation of the first control shaft results in lateral movement of the third tractor drive along the drive shaft, and a second control shaft comprising threads that is rotatable mounted to the frame, the second control shaft being connected to a bushing that engages the second tractor drive whereby rotation of the second control shaft results in lateral movement of the second tractor drive along the drive shaft, a first output part, the first control shaft being connected to the first output part, the first output part comprising a catch gearing that engages a rotational drive element, a second output part, the first control shaft passing through the second output part, the first control shaft being free to rotate within the second output part without rotation of the second output part, the second output part comprising a catch gearing that engages the drive element, the second output part also being coupled to a carrier part that is connected to the second control shaft, the drive element being slidably mounted to the first control shaft and movable along the first control shaft between engagement with the catch gearing of the first output part and the catch gearing of the second output part, the first output part further comprising a magnet for securing the drive element against the first output part when the drive element is moved into engagement with the first output part for imparting rotational movement to the first output part, the second output part further comprising a magnet for securing the drive element against the second output part when the drive element is moved into engagement with the second output part for imparting rotational movement to the second output part.

17. The transfer printing station of claim 16 wherein the second output part is coupled to the carrier part by a ring gear that is disposed between the second output part and the carrier part and that is enmeshed with the second output part and the carrier part.

18. The transfer printing station of claim 16 wherein the drive element comprises a handle for imparting rotation to the drive element.

19. The transfer printing station of claim 16 further comprising a frame with a catch pin being mounted to the frame at selected positions along the frame, the catch pin engaging the fourth tractor drive and securing the fourth tractor drive in position.

20. The transfer printing station of claim 16 further comprising a first plate spring disposed between the second output part and the first control shaft to prevent rotation of the first control shaft with respect to the second output part during operation of the printing station, and a second plate spring disposed between the carrier part and the second control shaft and preventing rotation of the second control shaft with respect to the carrier part during operation of the printing station.

21. The transfer printing station of claim 16 wherein the first control shaft is threadably connected to the third tractor drive by a threaded bushing, and wherein the second control shaft is threadably connected to the second tractor drive by a threaded bushing.

22. A printer comprising a transfer printing station for conveying one single wide paper web or one or two narrower paper webs, each paper web having opposing edges with perforations therein, the printer comprising:

at least one drive shaft, two pairs of tractor drives including a first tractor drive pair including a first tractor drive and a second tractor drive and a second tractor drive pair including a third tractor drive and a fourth tractor drive, said at least one drive shaft passing through the first and second tractor drive pairs, the second tractor drive being disposed along the drive shaft between the first and third tractor drives, the third tractor drive being disposed along the drive shaft between the second and fourth tractor drives, each pair of tractor drives for engaging perforations in opposing edges of one of the paper webs, the transfer printing station further comprising a transfer printing region and a distal park region, the distal park region being disposed adjacent to the transfer printing region, the distal park region having a width sufficient to accommodate the second pair of tractor drives, the transfer printing region having a width sufficient to accommodate one single wide paper web and the first pair of tractor drives or two narrower paper webs and the first and second pair of tractor drives, the drive shaft passing through the transfer printing region to the distal park region, a first control shaft comprising threads that is rotatable mounted to the frame, the first control shaft being connected to a bushing which engages the third tractor drive whereby rotation of the first control shaft results in lateral movement of the third tractor drive along the drive shaft, and a second control shaft comprising threads that is rotatably mounted to the frame, the second control shaft being connected to a bushing that engages the second tractor drive whereby rotation of the second control shaft results in lateral movement of the second tractor drive along the drive shaft, a first output part, the first control shaft being connected to the first output part, the first output part comprising a catch gearing that engages a rotational drive element, a second output part, the first control shaft passing through the second output part, the first control shaft being free to rotate within the second output part without rotation of the second output part, the second output part comprising a catch gearing that engages the drive element, the second output part being enmeshed with a ring gear that is enmeshed with toothed wheel that is connected to the second control shaft, the drive element being slidably mounted to the first control shaft and movable along the first control shaft between engagement with the catch gearing of the first output part and the catch gearing of the second output part, the drive element comprising a handle for imparting rotation to the drive element, the first output part further comprising a magnet for securing the drive element against the first output part when the drive element is moved into engagement with the first output part for imparting rotational movement to the first output part, the second output part further comprising a magnet for securing the drive element against the second output part when the drive element is moved into engagement with the second output part for imparting rotational movement to the second output part, the first control shaft comprising a first plate spring that engages the second output part to prevent rotation of the first control shaft with respect to the second output part during operation of the printer, the second control shaft comprising a second plate spring disposed between the toothed wheel and the second control shaft and preventing rotation of the second control shaft with respect to the toothed wheel during operation of the printer, the printer further comprising a frame with a catch pin being mounted to the frame at selected positions along the frame, the catch pin engaging the fourth tractor drive and securing the fourth tractor drive in position.

* * * * *